United States Patent [19]

Mann

[11] Patent Number: 4,471,539

[45] Date of Patent: Sep. 18, 1984

[54] FOOTWEAR HAVING AN AUXILIARY POCKET

[76] Inventor: William C. Mann, 2336 Hillsbury Rd., Westlake Village, Calif. 91361

[21] Appl. No.: 436,927

[22] Filed: Oct. 26, 1982

[51] Int. Cl.[3] ..... A43B 3/12; A43B 23/00

[52] U.S. Cl. ..... 36/11.5; 36/136

[58] Field of Search ..... 36/136, 11.5, 134

[56] References Cited

U.S. PATENT DOCUMENTS

| | | | |
|---|---|---|---|
| D. 143,391 | 1/1946 | Barlow | 36/136 |
| 261,695 | 11/1981 | Gamm . | |
| 654,388 | 7/1900 | Diemer . | |
| 2,421,796 | 6/1947 | Maling | 36/136 |
| 2,662,677 | 12/1953 | Perry . | |
| 2,712,700 | 7/1955 | Solomon | 36/136 |
| 3,018,570 | 1/1962 | Bliese . | |
| 4,280,287 | 7/1981 | Gulbransen | 36/136 |
| 4,296,559 | 10/1981 | Gamm | 36/136 |
| 4,372,060 | 2/1983 | Adamik | 36/136 |

FOREIGN PATENT DOCUMENTS

| | | | |
|---|---|---|---|
| 2067385 | 7/1981 | United Kingdom | 36/136 |

*Primary Examiner*—Werner H. Schroeder
*Assistant Examiner*—Steven N. Meyers
*Attorney, Agent, or Firm*—Finnegan, Henderson, Farabow, Garrett & Dunner

[57] ABSTRACT

Footwear with a sole portion for protecting the lower surface of a foot only and support means for slidably receiving the foot for securing the footwear thereto while leaving the toes, heel, and ankle entirely exposed is provided with a pocket on or in the support means opening outwardly to permit insertion and removal of small items. A closure means at the opening of the pocket permits selective restricting of access to the pocket. In one embodiment the pocket is formed in the space between two superimposed layers of material comprising the support means, and the opening of the pocket is formed in the one of the two layers outermost from the foot of the wearer.

8 Claims, 5 Drawing Figures

FOOTWEAR HAVING AN AUXILIARY POCKET

BACKGROUND OF THE INVENTION

1. Field of the Invention

This invention relates to footwear in which the toes, heel, and ankle of the wearer are entirely exposed, and more particulary to such footwear having an auxiliary pocket therein.

2. Background Art

There are occasions upon which an individual for convenience will choose to wear abbreviated footwear lacking laces, buckles or snaps, and consisting exclusively of a sole portion for protecting the bottom of the foot and a width of material attached to the sole portion at each side of the foot in the region of the instep for receiving the foot when it is slid forward longitudinally along the sole portion, thereby to secure the footwear to the foot. The footwear contemplated provides neither enclosure for the ankle or heel of the wearer nor covering for the toes thereof.

Footwear of this type can be quickly and conveniently put on or removed by a wearer without the need to bend over and use the hands in doing so. Furthermore, such footwear by lacking an upper of any significance is comfortable to wear in warm, moist, or steamy environments and will not retain against the foot particles of sand or bits of gravel which may be kicked up, as when walking on a beach. By freeing the ankle, heel, and toes of the wearer, this type of footwear also permits tanning of major portions of the foot when worn outdoors in the sun and allows rapid evaporation of any perspiration or other moisture on the foot. Some types of this abbreviated footwear, when made of waterproof materials, can be worn while showering without trapping soap or water on the foot of the wearer.

It is frequently the case that an individual wearing such abbreviated footwear will in addition thereto be wearing apparel, or a type of covering, having no pockets. Such might be the case in walking to or from the ocean at a beach resort, in attending a poolside activity, in visiting a hot tub or Jacuzzi, or in taking a sauna or shower. In such and similar circumstances, the wearer may nevertheless have need to carry small personal items, such as automobile, house, or hotel keys, money, or identification of some type. Nevertheless, given the raiment or lack thereof appropriate to the occasion, no pockets are available in which such objects may be securely stored. Hence, at least one hand must be employed to carry such items, and when freedom from this encumberance is desired, the items are frequently placed in the open, upon the ground, a bench, or the like, occasionally wrapped in a towel or otherwise concealed, and thus are frequently lost. As a result, many persons forego the convenience of carrying keys, money, or identification at such times. Thus, under circumstances like those described above, the need has been perceived and continues to exist for a satisfactory means of transporting and keeping small personal items.

SUMMARY OF THE INVENTION

It is therefore one object of the present invention to permit a wearer of the abbreviated footwear described in any of the mentioned or similar environments to possess small personal items such as keys, money, or identification without having to carry them in hand.

Another object of the invention is to provide means whereby such items may be stored out of plain view, when a person's articles of apparel have no pockets and a handbag is inappropriate.

Still another object of the present invention is to create an item of footwear which accomplishes both of the above-stated objectives and is economical and simple to manufacture.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects and in accordance with the invention, as embodied and broadly described herein, footwear is provided comprising substantially planar sole means for protecting only the lower surface of the foot; support means attached to the sole means for slidably receiving the forepart of the foot when the foot is advanced forwardly and longitudinally along said sole means in proximity thereto, the toes extending beyond said support means and the ankle and heel being entirely exposed when the forepart of the foot is received in the support means; and pocket means located in or on the support means.

Preferably, the support means comprises double layers of material, and the pocket means is formed between the layers and opens outwardly through an opening in the one of said layers outermost from the foot. Closure means is provided in the opening for selectively affording or restricting access to the pocket means. Alternately, the pocket means is formed by the layers themselves.

BRIEF DESCRIPTION OF THE DRAWINGS

The invention will be described with additional specificity and detail through the use of the accompanying drawings in which.

DESCRIPTION OF THE PREFERRED EMBODIMENT

Figure 1:
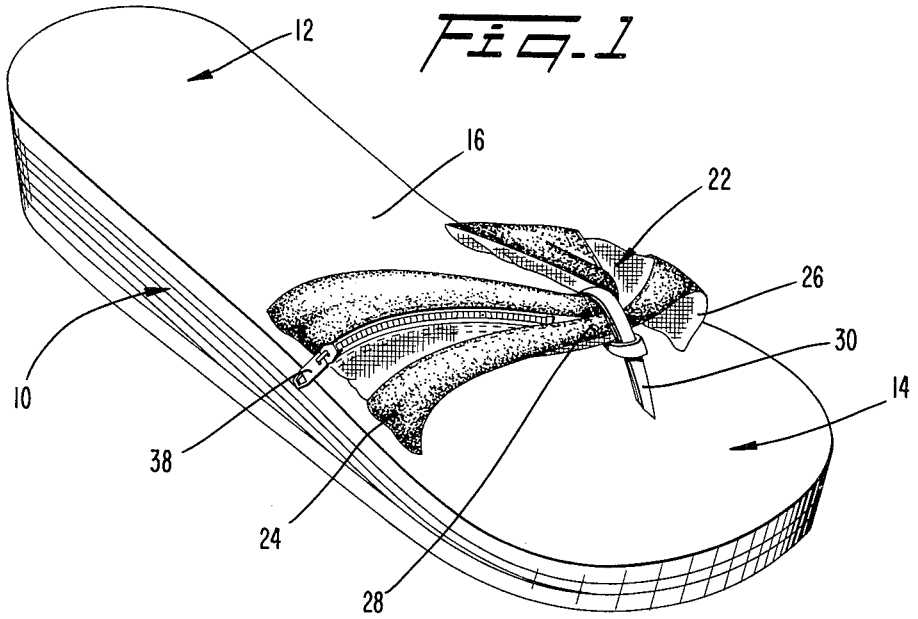
FIG. 1 is a prespective view of footwear incorporating the teachings of the present invention.
Figure 2:
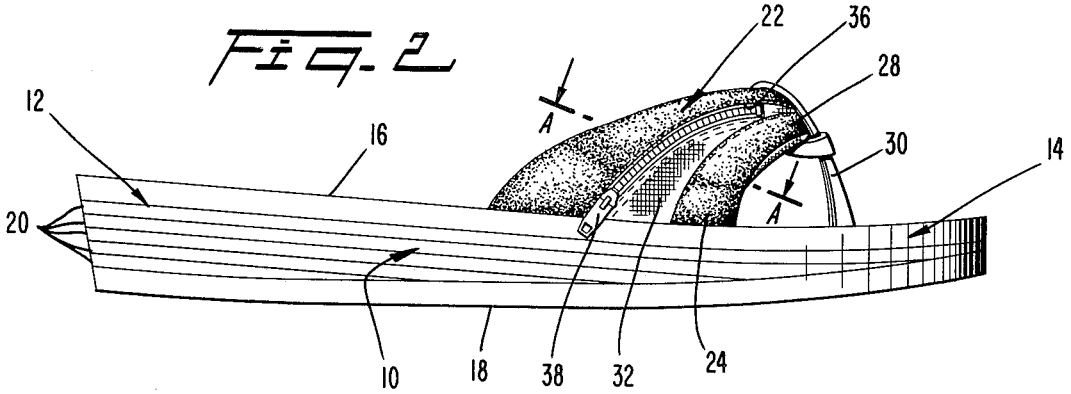
FIG. 2 is a side view of the footwear depicted in FIG. 1.

FIG. 1 depicts an item of footwear embodying the teachings of the present invention. In accordance with one aspect of the present invention, substantially planar sole means are provided for protecting exclusively the lower surface of the foot of a wearer. As embodied herein, there is shown in FIGS. 1 and 2 a substantially planar sole portion 10 for the footwear having a heel 12, a toe 14, an upper surface 16, and a lower surface 18 which engages the ground. The sole portion 10 shown is composed of a number of laminated layers 20; however, sole portion 10 can equally satisfactorily be made of a solid piece of material. Sole portion 10, as shown in FIG. 2, is thicker at heel 12 than at toe 14, thereby causing top surface 16 thereof to be slightly inclined downward from heel 12 to toe 14 when the footwear depicted rests upon the ground. Such tapering of the thickness of sole portion 10 is, nevertheless, not required by the invention.

In accordance with another aspect of the present invention there is provided support means attached to a sole means, such as sole portion 10, for slidably receiving the forepart of the foot of a wearer when the foot is advanced forwardly and longitudinally along the sole means in proximity thereto. As best seen in FIG. 1, there is shown, by way of example and not limitation, a strap 22 arching over sole portion 10 having ends 24, 26 which are attached to top surface 16 at outer portions thereof in the vicinity of or slightly forward from the instep of the wearer.

In use, a wearer puts on the footwear depicted in FIG. 1 by sliding the toes of the foot forward from heel 12 along the length of sole portion 10 while in close proximity or contact with top surface 16. The toes pass beneath strap 22 permitting the forepart of the foot to be received by strap 22. Thus, when the abbreviated footwear shown are worn, the toes of the wearer extend beyond strap 22 to rest upon toe 14 of sole portion 10, while the heel of the wearer rests upon heel 12. It can be readily appreciated that the toes, ankle and heel of a wearer are thereby entirely exposed when the forepart of the foot is received in a support means, such as strap 22.

Strap 22 is depicted as being broadest at ends 24, 26 while narrowing toward a medial portion 28. It should be noted that strap 22 need not taper toward medial portion 28 as shown in order to accomplish the objects of the present invention. Rather, the support means could comprise a strap of uniform breadth. In addition, a thong 30 may be secured by any number of known means between top surface 16 of sole portion 10 and strap 22 for passing between the toes of a wearer when the forepart of the foot is received by strap 22.

Figure 3:
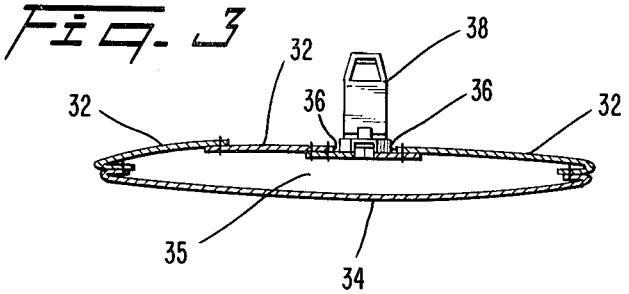
FIG. 3 is a cross sectional view of a portion of the footwear of FIG. 2 taken along line A—A.
Figure 4:
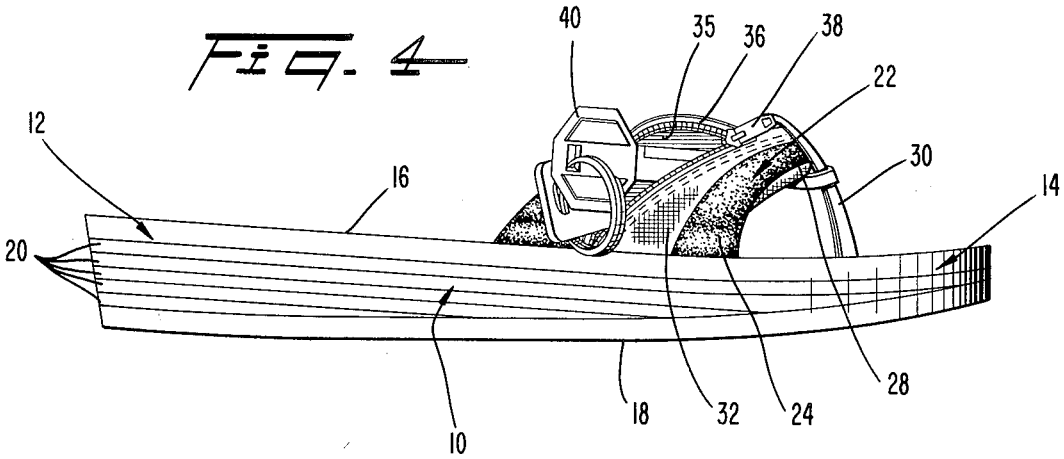
FIG. 4 is the same view as FIG. 2 showing therein a closure means opened to admit therethrough a pair of keys.

In accordance with another aspect of the invention, pocket means are located in or on a support means, such as strap 22. As embodied herein and shown in FIG. 3, strap 22 is made of outer and inner layers of material 32, 34, respectively. Between layers 32, 34 is formed a space or pocket 35 which opens outwardly through an opening 36 in outer layer 32 outermost from the foot. In accordance with another aspect of the present invention, an opening, such as opening 34, is provided with a closure means, which preferably is a zipper 38 for selective closure of opening 36 to prevent access to space or pocket 35. FIG. 4 shows zipper 38 opened and a pair of keys 40 in the process of being inserted into pocket 35 or withdrawn therefrom.

Figure 5:
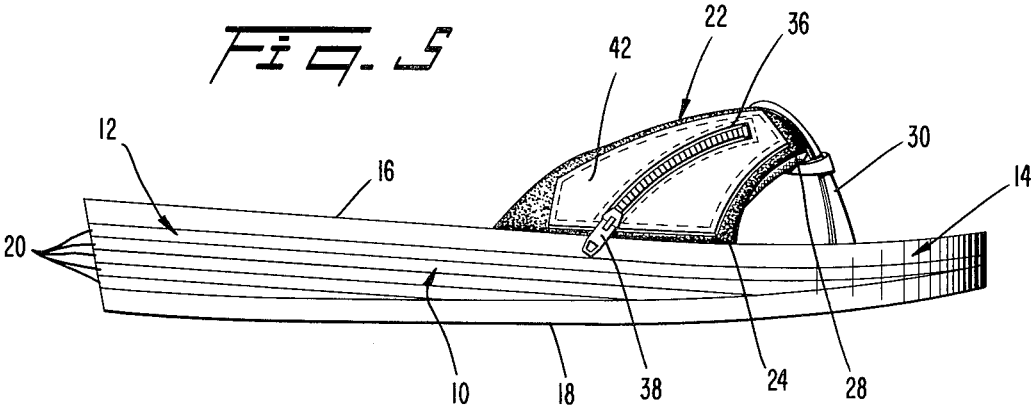
FIG. 5 is a side view of an alternative embodiment of the present invention.

The pocket located at strap 22 can be formed in a number of ways. Layers 32, 34 being attached to each other at the shared peripheries thereof, can themselves form the front and back walls of such a pocket. On the other hand, layers 32, 34 can enclose a pre-formed pocket attached to outer layer 32 at opening 36. Alternatively, zipper 38 can be fabricated as part of a preformed pocket which is then attached within strap 22 at opening 36 with zipper 38 exposed therethrough for manipulation. Finally, as shown in an alternate embodiment in FIG. 5, a preformed pocket 42 having an opening 36 provided with closure means in the form of a zipper 38 can be attached to the exterior of strap 22. In such an instance, strap 22 need not necessarily be composed of a double layer of material. In addition, a pocket on the exterior of strap 22 can be formed by attaching to the outer surface of strap 22 a single layer of material containing an opening 36 with a zipper 38 therein. The single layer then functions as the outer wall of the pocket, while the outer surface of strap 22 serves as the inner wall of the pocket.

Thus, according to the above-described invention, a means is provided whereby it is possible for one wearing abbreviated footwear having a sole for protecting only the lower surface of the foot and having support means which receive the forepart of the foot, but leave the heel, ankle, and toes thereof entirely exposed, to carry and maintain out of plain view small items, even when the clothing being worn by such a person does not afford pockets in which to do so.

It will be apparent to those skilled in the art that modifications and variations can be made in the apparatus of this invention. The invention in its broader aspects is, therefore, not limited to the specific details, representative methods and apparatus, and illustrative examples shown and described. Accordingly, alterations may be made from such details without departing from the spirit or scope of Applicant's general inventive concept.

What is claimed is:

1. Footwear comprising:

a. substantially planar sole means for protecting only the lower surface of the foot;

b. strap-like support means attached to said sole means for slidably receiving the forepart of the foot when the foot is advanced forwardly and longitudinally along said sole means in proximity thereto, the toes extending beyond said support means and the ankle, toes, heel, and a substantial portion of the forepart of the foot being entirely exposed when the forepart of the foot is received in said support means; and c. pocket means located in said support means;

wherein said support means comprises a double layer of material, and wherein said pocket means is formed between said layers and opens outwardly through an opening in the one of said layers outermost from the foot.

2. Footwear as recited in claim 1, also including closure means in said opening.

3. Footwear as recited in claim 2, wherein said closure means is a zipper.

4. Footwear comprising:

a. substantially planar sole means fo protecting only the lower surface of the foot;

b. strap-like support means attached to said sole means for slidably receiving the forepart of the foot when the foot is advanced forwardly and longitudinally along said sole means in proximity thereto, the toes extending beyond said support means and the ankle, toes, heel, and a substantial portion of the forepart of the foot being entirely exposed when the forepart of the foot is received in said support means; and c. pocket means located in said support means;

wherein said support means comprises two generally congruent layers of material, and wherein said pocket means formed by said layers and opens outwardly through an opening in the one of said layers outermost from the foot.

5. Footwear as recited in claim 4, also including closure means in said opening.

6. Footwear as recited in claim 5, wherein said closure means is a zipper.

7. Footwear comprising:

a. substantially planar sole means for protecting only the lower surface of the foot;

b. strap-like support means attached to said sole means for slidably receiving the forepart of the foot when the foot is advanced forwardly and longitudinally along said sole means in proximity thereto, the toes extending beyond said support means and the ankle, toes, heel, and a substantial portion of the forepart of the foot being entirely exposed when the forepart of the foot is received by said support means, said support means comprising two generally congruent layers of material, said layers being attached to each other at the shared peripheries thereof for forming a space therebetween, the one of said layers outermost from the foot having formed therein an opening into said space;

c. a thong secured between said sole means and said support means for passing between the toes when said forepart of the foot is received by said support means; and d. closure means in said opening for selectively affording of restricting access to said space between said layers of said support means.

8. Footwear as recited in claim 7, wherein said closure means is a zipper.

* * * * *